US005245273A

United States Patent [19]

Greaves et al.

[11] Patent Number: 5,245,273

[45] Date of Patent: Sep. 14, 1993

[54] BANDGAP VOLTAGE REFERENCE CIRCUIT

[75] Inventors: Carlos A. Greaves; Mauricio A. Zavaleta, both of Austin, Tex.

[73] Assignee: Motorola, Inc., Schaumburg, Ill.

[21] Appl. No.: 785,120

[22] Filed: Oct. 30, 1991

[51] Int. Cl.[5] ..... G05F 3/26

[52] U.S. Cl. ..... 323/313; 323/315; 307/296.1; 307/296.6; 365/189.09

[58] Field of Search ..... 323/313, 314, 315; 307/296.1, 296.5, 296.6, 296.7, 296.8; 365/189.09

[56] References Cited

U.S. PATENT DOCUMENTS

| | | | |
|---|---|---|---|
| 4,342,926 | 8/1982 | Whatley | 307/297 |
| 4,896,094 | 1/1990 | Greaves et al. | 323/314 |
| 5,045,773 | 9/1991 | Westwick et al. | 323/316 |
| 5,126,653 | 6/1992 | Ganesan et al. | 323/313 |

OTHER PUBLICATIONS

Gray, Paul R. and Meyer, Robert G., Analysis and Design of Analog Integrated Circuits, Second Edition, John Wiley & Sons, Inc. 1984, Chapter 12, p. 716.

*Primary Examiner*—Emanuel T. Voeltz

*Attorney, Agent, or Firm*—Maurice Jay Jones; Paul J. Polansky

[57] ABSTRACT

A bandgap voltage reference circuit (50, 100) which operates at low power supply voltages provides a reference current as either a one- or a two-$\Delta V_{BE}$ voltage across a first resistor (82, 133). A current proportional to the reference current is mirrored into one terminal of a second resistor (94, 133) to provide the bandgap voltage. Compensation for base currents injected into the circuit (50, 100) by two transistors forming the $\Delta V_{BE}$ reference is provided. In one embodiment (50), base currents of first (66) and second (87) transistors which have equal emitter areas and collector current density as the two transistors (68, 85) forming the $\Delta V_{BE}$ reference compensate for the injected base currents. In another embodiment (100), a single transistor (127) injects current substantially equal to the sum of the base currents of the two transistors (116, 121) forming the $\Delta V_{BE}$ reference. The single transistor (127) has twice the emitter area of one of the transistors (116) forming the $\Delta V_{BE}$ reference.

21 Claims, 3 Drawing Sheets

-PRIOR ART-

50

BANDGAP VOLTAGE REFERENCE CIRCUIT

FIELD OF THE INVENTION

This invention relates generally to voltage and current reference circuits, and more particularly, to bandgap voltage reference circuits.

BACKGROUND OF THE INVENTION

A bandgap reference circuit provides a stable, precise output reference voltage for use in various analog circuits. The bandgap reference circuit is typically used in large integrated circuits for applications such as telecommunications. Bandgap reference circuits preferably provide a continuous reference voltage. It is also desirable for the output reference voltage to remain stable over varying operating conditions, such as temperature and manufacturing process variations. Recently, it has become necessary for many commercial integrated circuits to operate at less than the conventional five-volt power supply voltage, such as at three volts. Thus, bandgap reference circuits must operate over a power supply voltage range from over five volts down to three volts and less. The output reference voltage provided by known bandgap reference circuits, however, typically varies somewhat with respect to one or more of these factors. Known bandgap reference circuits also typically fail to function when the power supply voltage is lowered to three volts.

One method of providing a voltage reference is to provide a stable reference current through a precision resistor. Stable reference current circuits are known in the art. The reference current circuits may provide reference voltages which are applied to the gates of transistors in other circuits to reproduce the reference current. For example, a common type of current reference circuit provides a voltage generally designated as "NBIAS". NBIAS, when applied to the gate of an MOS N-channel transistor, produces a gate-to-source voltage which biases the transistor to have a relatively-constant drain-to-source current over wide variations in drain-to-source voltage. Thus NBIAS can be applied to the gate of an N-channel transistor whose drain is connected to a precision resistor, to provide the voltage reference.

There are at least two problems with this approach. First, known current reference circuits can produce bias voltages to reproduce currents which are suitably precise for circuits such as differential amplifiers, yet too variable for bandgap reference voltage circuits. The variability may be tolerable at higher power supply voltages, but become intolerable at lower voltages, such as at three volts. Furthermore, a known type of precision resistor available in MOS integrated circuit processing technology utilizes a specified amount of polysilicon. However, since the magnitude of current of a typical N-channel MOS transistor biased into saturation is small, and the resistivity of polysilicon is relatively small, the amount of polysilicon required to provide a suitable voltage drop for a bandgap reference voltage is quite large. Thus, valuable integrated circuit area is consumed.

SUMMARY OF THE INVENTION

Accordingly, there is provided, in one form, a bandgap voltage reference circuit comprising means for providing a first reference current; a first resistor having a first terminal for providing a reference voltage, and a second terminal; means for mirroring a second reference current into the first terminal of the first resistor, the second reference current proportional to the first reference current; a first transistor having an emitter coupled to the second terminal of the first resistor, and having a base and a collector each coupled to a power supply voltage terminal; and means coupled to the second terminal of the first resistor for injecting a base current substantially equal to a base current of the first transistor into an emitter of the first transistor.

In another form, there is provided a circuit comprising a reference node, current means, first and second current mirrors, feedback means, and compensation means. The current means provides a reference current equal to a $V_{BE}$ of a first transistor plus a $V_{BE}$ of a second transistor minus a $V_{BE}$ of a third transistor minus a $V_{BE}$ of a fourth transistor, divided by a value of a first resistor, the reference current flowing into an emitter of the fourth transistor, a second current flowing into an emitter of the first transistor, a third current proportional to the reference current flowing into an emitter of the third transistor, a fourth current proportional to the second current flowing into an emitter of the second transistor. The first current mirror mirrors a fifth current proportional to the second current into the reference node. The second current mirror mirrors a sixth current proportional to the reference current from the reference node. The feedback means is coupled to the reference node and to the first current mirror, and changes the second current until the fifth current is substantially equal to the sixth current. The compensation means adds a base current of the second and third transistors to the sixth current.

In yet another form, there is provided a circuit comprising a reference node, current means, first and second current mirrors, and feedback means. The current means provides a reference current equal to a $V_{BE}$ of a first transistor minus a $V_{BE}$ of a second transistor, divided by a value of a first resistor, the reference current flowing into an emitter of the second transistor. The current means also provides a second current flowing into an emitter of the first transistor. The first current mirror mirrors a third current proportional to the second current into the reference node. The second current mirror mirrors a fourth current proportional to the reference current into the reference node. The second current mirror is characterized as being a high-swing cascode current mirror. The feedback means is coupled to the reference node and to the first current mirror, and changes the second current until the third current is substantially equal to the fourth current.

These and other features and advantages will be more clearly understood from the following detailed description taken in conjunction with the accompanying drawings.

DETAILED DESCRIPTION OF THE INVENTION

Figure 1:
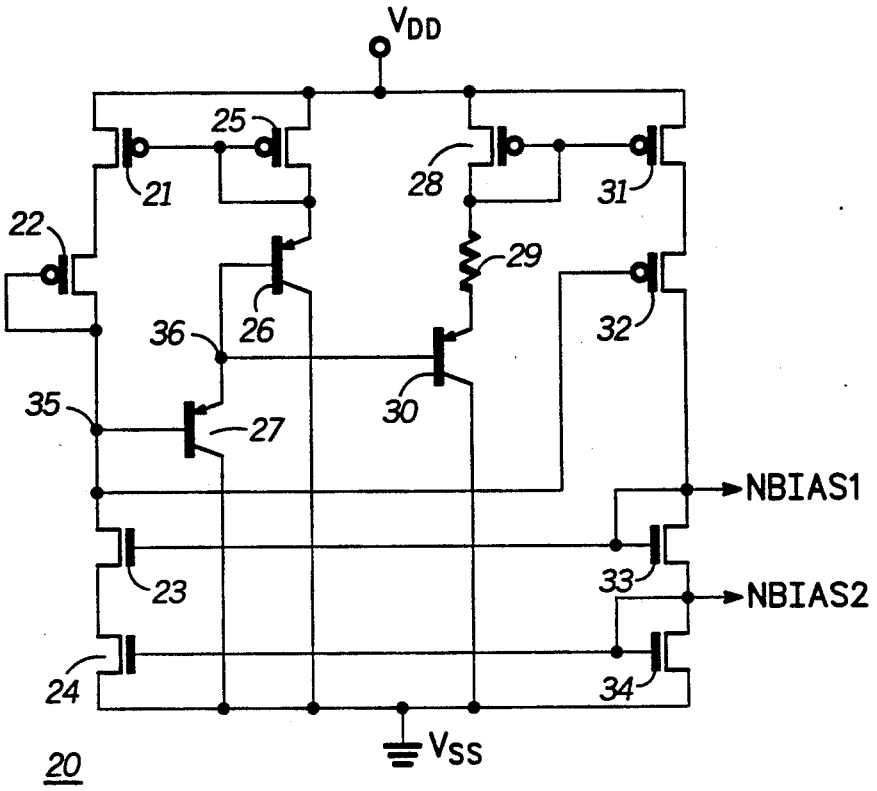
FIG. 1 illustrates in schematic form a known current source circuit.

FIG. 1 illustrates in schematic form a current source circuit 20 as disclosed in U.S. Pat. No. 5,045,773, entitled "Current Source Circuit with Constant Output," by Alan Lee Westwick and Roger Allan Whatley and assigned to the assignee hereof, which is herein incorporated by refernece. Current source circuit 20 includes P-channel transistors 21 and 22, N-channel transistors 23 and 24, a P-channel transistor 25, PNP transistors 26 and 27, a P-channel transistor 28, a resistor 29, a PNP transistor 30, P-channel transistors 31 and 32, and N-channel transistors 33 and 34. Transistor 21 has a source connected to a power supply voltage terminal labelled "$V_{DD}$", a gate, and a drain. $V_{DD}$ is a positive power supply voltage terminal which may have a nominal voltage of five volts. Transistor 22 has a source connected to the drain of transistor 21, a gate, and a drain connected to the gate of transistor 22 at a reference node 35. Transistor 23 has a drain connected to the drain of transistor 22, a gate, and a source. Transistor 24 has a drain connected to the source of transistor 23, a gate, and a source connected to a power supply voltage terminal labelled "$V_{SS}$". $V_{SS}$ is a negative or ground power supply voltage terminal which may be zero volts. Transistor 25 has a source connected to $V_{DD}$, a gate, and a drain connected to the gates of transistors 21 and 25. Transistor 26 has an emitter connected to the drain of transistor 25, a base, and a collector connected to $V_{SS}$. Transistor 27 has an emitter connected to the base of transistor 26, a base connected to the drain of transistor 23, and a collector connected to $V_{SS}$. Transistor 28 has a source connected to $V_{DD}$, a gate, and a drain connected to the gate of transistor 28. Resistor 29 has a first terminal connected to the drain of transistor 28, and a second terminal. Transistor 30 has an emitter connected to the second terminal of resistor 29, a base connected to the emitter of transistor 27, and a collector connected to $V_{SS}$. Transistor 31 has a source connected to $V_{DD}$, a gate connected to the drain of transistor 28, and a drain. Transistor 32 has a source connected to the drain of transistor 31, a gate connected to the drain of transistor 23, and a drain connected to the gate of transistor 23 for providing an output reference voltage labelled "NBIAS1". Transistor 33 has a drain connected to the drain of transistor 32, a gate connected to the drain of transistor 32, and a source. Transistor 34 has a drain connected to the source of transistor 33 and to the gate of transistor 24 and providing a second output reference voltage labelled "NBIAS2" thereon, a gate connected to the drain of transistor 34, and a source connected to $V_{SS}$.

Circuit 20 provides a reference current which is stable with respect to changes in the power supply voltage. The reference current is generated by providing a voltage, known as "delta $V_{BE}$" or "$\Delta V_{BE}$", across a known precision resistor 29. Since $\Delta V_{BE}$ represents the difference between the base-to-emitter voltages of two transistors, the $\Delta V_{BE}$ reference is relatively insensitive to variations in the power supply voltage $V_{DD}$ and to manufacturing process variations. In addition to providing the reference current, circuit 20 provides voltages NBIAS1 and NBIAS2 to bias N-channel transistors to reproduce the reference current.

The voltage across resistor 29 can be determined by using Kirchoff's voltage law and summing voltages around a loop. Starting with the voltage at the drain of transistor 25, $$-V_{BE26}+V_{BE30}+I_{29}R_{29}+V_{GS28}-V_{GS25}=0 \quad [1]$$

where $V_{BE26}$ is the base-to-emitter voltage of transistor 26, $I_{29}$ is the current through resistor 29, $V_{GS28}$ is the gate-to-source voltage of resistor 28, and so on. In the following discussion, V refers to voltage, I refers to current, R refers to resistance, and a subscript appended thereto refers to both the device parameter and the respective circuit element involved.

Assuming that ($V_{GS28}=V_{GS25}$), which would occur with matched transistor lengths and widths, and rearranging, equation [1] can be rewritten as $$I_{29}=(V_{BE26}-V_{BE30})/R_{29} \quad [2]$$

or more simply as $$I_{29}=\Delta V_{BE}/R_{29} \quad [3]$$

where $\Delta V_{BE}$ is equal to ($V_{BE26}-V_{BE30}$). It can be easily shown that by rotioing the emitter area of transistor 30 to the emitter area of transistor 26, then $\Delta V_{BE}$ can be nonzero and therefore used to generate a current reference. From basic bipolar transistor theory, $$V_{BE}=(kT/q)(ln(I_C/I_S)) \quad [4]$$

where k is Boltzmann's constant, T is the temperature, q is the electronic charge, ln is the natural log, $I_C$ is the collector current, and $I_S$ is the reverse saturation current. Thus, combining [3] and [4] yields $$\begin{aligned} I_{29} &= [(kT/q)(\ln(I_{C26}/I_{S26}) - \ln(I_{C30}/I_{S30}))]/R_{29} \quad [5] \\ &= [(kT/q)\ln(I_{S30}/I_{S26})]/R_{29} \\ &= K/R_{29} \end{aligned}$$

assuming ($I_{C26}=I_{C30}$). If $I_S$ designates the saturation current density of a transistor with a unit size, then ($I_{S26}=A_{26}I_S$), where $A_{26}$ is the emitter area of transistor 26. Also, ($I_{S30}=A_{30}I_S$), where $A_{30}$ is the emitter area of transistor 30. The ratio ($A_{30}/A_{26}$) can be determined by the relative sizing of emitter areas between transistors 26 and 30 as long as the collector current is the same between the two circuit branches. Thus, current $I_{29}$ is proportional to a constant, labelled "K", which is equal to [(kT/q)ln($A_{30}/A_{26}$)].

Circuit 20 provides a feedback mechanism to ensure that current $I_{29}$ and the current flowing through transistor 25 into the emitter of transistor 26, labelled $I_{26}$, are approximately equal. Transistors 23, 24, 33, and 34 form a cascode current mirror to mirror a current proportional to current $I_{29}$ through transistors 23 and 24. In general, the cascode current mirror is considered to provide a current into node 35. However it should be noted that a positive current flows from node 35 through transistors 23 and 24 to $V_{SS}$; thus, the cascode current mirror provides a negative current into node 35. In addition, transistor 25 mirrors current $I_{25}$ to node 35 through transistors 21 and 22. The voltage at the drain of transistor 22, reference node 35, is equal to $V_{DD}$ minus the gate-to-source voltage of transistor 25, minus the base-to-emitter voltage of transistor 26, minus the base-to-emitter voltage of transistor 27. As the voltage at the drain of transistor 22 varies, the base-to-emitter voltages of transistors 27 and 26 also vary, which then varies the gate-to-source voltage of transistor 25. These voltage variations alter the gate-to-source voltage of transistor 21 until ($I_{26} \approx I_{29}$).

The emitter-base junction of transistor 27 is connected between the bases of transistors 26 and 30, and the drain of transistor 22. Thus, base current from transistor 27 is injected as an error current to node 35. The base current of a bipolar transistor is equal to the inverse of the transistor's beta ($\beta$) times the collector current, or ($I_B=(1/\beta)(I_C)$). In some integrated circuit processes such as standard CMOS, vertical-mode bipolar transistors are available. The base current of a vertical-mode bipolar transistors is relatively high in relation to the collector current ($\beta$ is relatively low). Thus, in these processing technologies, the base currents of transistors 26 and 30 are not negligible. If the bases of transistors 26 and 30 were connected to the drain of transistor 22 directly, then an error current proportional to ($1/\beta$) times the collector current of each transistor would be injected. However, transistor 27 reduces the error current injected at the drain of transistor 22 to $(1/\beta)^2$ times the collector current (assuming the $\beta$ of all transistors to be the same). Thus, the error current is lessened and the circuit is more stable.

Figure 2:
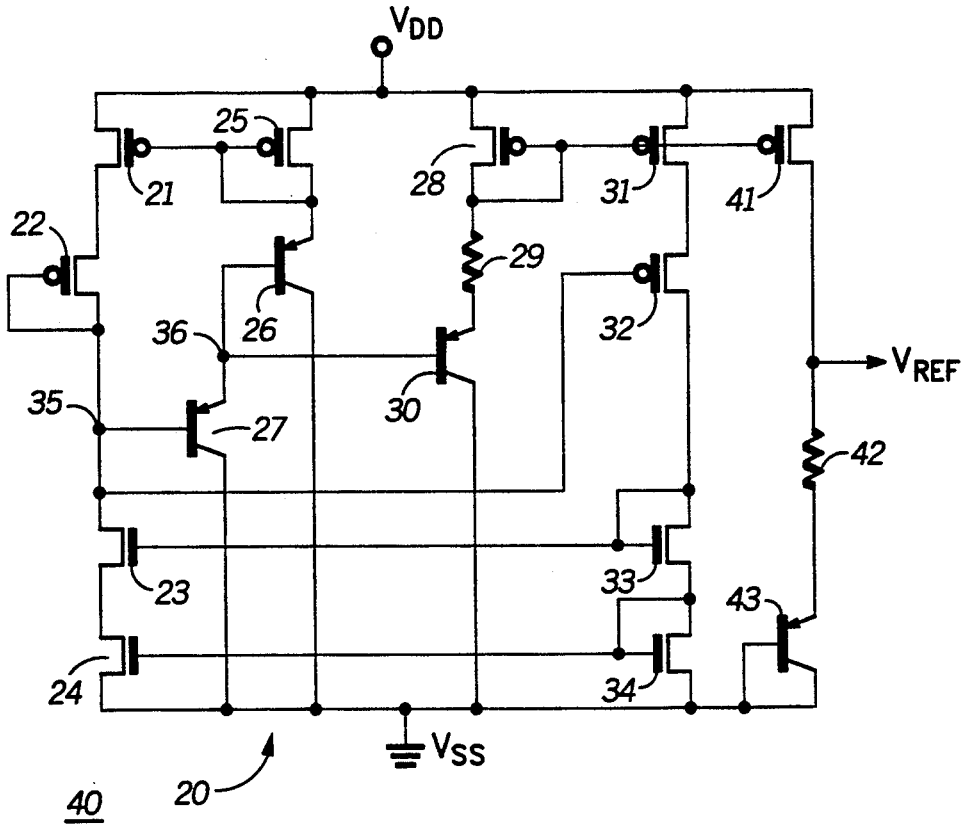
FIG. 2 illustrates in schematic form a bandgap reference circuit formed using the current source circuit of FIG. 1.

FIG. 2 illustrates in schematic form a bandgap reference circuit 40 formed using current source circuit 20 of FIG. 1. Circuit 40 additionally includes a P-channel transistor 41, a resistor 42, and a PNP transistor 43. Transistor 41 has a source connected to $V_{DD}$, a gate connected to the drain of transistor 28, and a drain for providing a voltage labelled $V_{REF}$. Resistor 42 has a first terminal connected the drain of transistor 41, and a second terminal. Transistor 43 has an emitter connected to the second terminal of resistor 42, and a base and drain each connected to $V_{SS}$. To provide $V_{REF}$, circuit 40 mirrors current $I_{29}$ through transistor 41 and into resistor 42 and the emitter of transistor 43. Thus, $$V_{REF}=V_{BE43}+I_{29}R_{42} \quad [6]$$

Substituting for $I_{29}$ in equation [6], $$V_{REF}=V_{BE43}+KR_{42}/R_{29} \quad [7].$$

$V_{REF}$ may additionally be made stable with respect to temperature variations because $V_{BE43}$ has a negative temperature coefficient, and ($KR_{42}/R_{29}$) has a positive temperature coefficient since $R_{42}$ is greater than $R_{29}$. The magnitude of the temperature coefficient of the term ($KR_{42}/R_{29}$) can be matched to offset the temperature coefficient of $V_{BE43}$ by varying the relative emitter areas of transistors 26 and 30 and the values of $R_{29}$ and $R_{42}$. Thus, a temperature-stable bandgap reference circuit is obtained.

However circuit 40 still suffers from base current errors which may alter the magnitude of $V_{REF}$. At node 35, current $I_{B27}$ is injected. Thus there is an imbalance in current between the current flowing through transistors 23 and 24 and the current flowing through transistors 33 and 34. As the magnitude of the current error increases, the balancing of the temperature coefficients in equation [7] is also lost. Thus, $V_{REF}$ may begin to vary with temperature. Furthermore, integrated circuit resistors require a large amount of area, and the combination of resistors 29 and 42 is very costly in terms of area.

Figure 3:
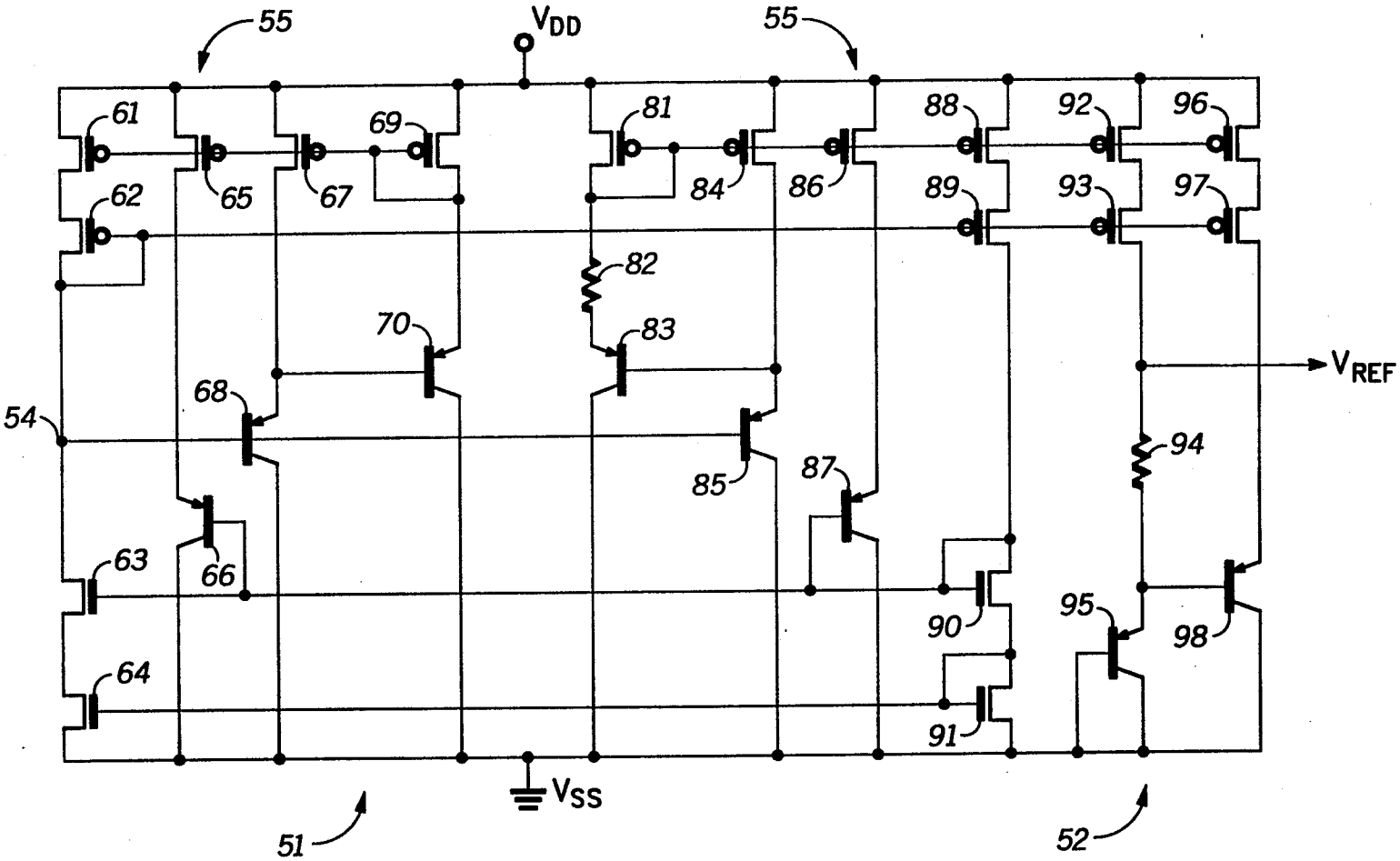
FIG. 3 illustrates in schematic form a bandgap reference circuit in accordance with the present invention.

FIG. 3 illustrates in schematic form a bandgap reference circuit 50 in accordance with the present invention. Bandgap reference circuit generally includes a reference current circuit 51, and a voltage generator circuit 52. Reference current circuit 51 includes P-channel transistors 61 and 62, N-channel transistors 63 and 64, a P-channel transistor 65, a PNP transistor 66, a P-channel transistor 67, a PNP transistor 68, a P-channel transistor 69, a PNP transistor 70, a P-channel transistor 81, a resistor 82, a PNP transistor 83, a P-channel transistor 84, a PNP transistor 85, a P-channel transistor 86, a PNP transistor 87, P-channel transistors 88 and 89, and N-channel transistors 90 and 91. Transistors 65, 66, 86, and 87 collectively form a compensation circuit labelled 55. Voltage generator circuit 52 includes P-channel transistors 92 and 93, a resistor 94, a PNP transistor 95, P-channel transistors 96 and 97, and a PNP transistor 98. Transistor 61 has a source connected to $V_{DD}$, a gate, and a drain. Transistor 62 has a source connected to the drain of transistor 61, a gate, and a drain connected to the gate of transistor 62. Transistor 63 has a drain connected to the drain of transistor 62, a gate, and a source. Transistor 64 has a drain connected to the source of transistor 63, a gate, and a drain connected to $V_{SS}$. Transistor 65 has a source connected to $V_{DD}$, a gate, and a drain. Transistor 66 has an emitter connected to the drain of transistor 65, a base, and a collector connected to $V_{SS}$. Transistor 67 has a source connected to $V_{DD}$, a gate, and a drain. Transistor 68 has an emitter connected to the drain of transistor 67, a base connected to the drain of transistor 62, and a collector connected to $V_{SS}$. Transistor 69 has a source connected to $V_{DD}$, a gate, and a drain connected to the gates of transistors 61, 65, 67, and 69. Transistor 70 has an emitter connected to the drain of transistor 69, a base connected to the drain of transistor 67, and a collector connected to $V_{SS}$. Transistor 81 has a source connected to $V_{DD}$, a gate and a drain connected to the gate of transistor 81. Resistor 82 has a first terminal connected to the drain of transistor 81, and a second terminal. Transistor 83 has an emitter connected to the second terminal of resistor 82, a base, and a collector connected to $V_{SS}$. Transistor 84 has a source connected to $V_{DD}$, a gate connected to the drain of transistor 81, and a drain connected to the base of transistor 83. Transistor 85 has an emitter connected to the drain of transistor 84 and to the base of transistor 83, a base connected to the drain of transistor 62, and a collector connected to $V_{SS}$. Transistor 86 has a source connected to $V_{DD}$, a gate connected to the drain of transistor 81, and a drain. Transistor 87 has an emitter connected to the drain of transistor 86, a base, and a collector connected to $V_{SS}$. Transistor 88 has a source connected to $V_{DD}$, a gate connected to the drain of transistor 81, and a drain. Transistor 89 has a source connected to the drain of transistor 88, a gate connected to the drain of transistor 62, and a drain connected to the gate of transistor 63 and to the bases of transistors 66 and 87. Transistor 90 has a drain connected to the drain of transistor 89, a gate connected to the drain of transistor 89, and a source connected to the gate of transistor 64. Transistor 91 has a drain connected to the source of transistor 90, a gate connected to the drain of transistor 90, and a source connected to $V_{SS}$.

In voltage generator circuit 52, transistor 92 has a source connected to $V_{DD}$, a gate connected to the drain of transistor 81, and a drain. Transistor 93 has a source connected to the drain of transistor 92, a gate connected to the drain of transistor 62, and a drain for providing output reference voltage $V_{REF}$. Resistor 94 has a first terminal connected to the drain of transistor 93, and a second terminal. Transistor 95 has an emitter connected to the second terminal of resistor 94, a base connected to $V_{SS}$, and a collector connected to $V_{SS}$. Transistor 96 has a source connected to $V_{DD}$, a gate connected to the drain of transistor 81, and a drain. Transistor 97 has a source connected to the drain of transistor 96, a gate connected to the drain of transistor 62, and a drain. Transistor 98 has an emitter connected to the drain of transistor 97, a base connected to the second terminal of resistor 94, and a collector connected to $V_{SS}$.

Much of bandgap reference circuit 50 may be understood by noting the correspondence with various elements of bandgap reference circuit 40. Reference current circuit 51 performs the same function as reference current circuit 20 of FIG. 1. However, there are important differences which improve the performance of circuit 50 over circuit 40 of FIG. 2. First, voltage generator circuit 52 includes compensation for a base current error of transistor 95. Second, compensation circuit 55 provides precise base current compensation for transistors forming the $\Delta V_{BE}$ reference. Third, reference current circuit 51 provides a reference current based on a difference of two base-to-emitter voltages, which forms a more accurate reference. Fourth, because a two-$\Delta V_{BE}$ reference is used, the size of resistor 94 may be reduced for a given value of $V_{REF}$, saving circuit area.

The two-$\Delta V_{BE}$ reference can be analyzed as before, by applying Kirchoff's voltage law around the loop beginning at the drain of transistor 69:

$$-V_{BE70}-V_{BE68}+V_{BE85}+V_{BE83}+I_{82}R_{82}=0 \quad [8]$$

again assuming that the gate-to-source voltages of transistors 69 and 81 are equal. If the emitter areas of transistors 68 and 70 are made equal, and the emitter areas of transistors 83 and 85 are made equal, then the reference current $I_{82}$ may be expressed as $$I_{82}=2(V_{BE70}-V_{BE83})/R_{82}=2\Delta V_{BE}/R_{82}=2K'/R_{82} \quad [9]$$

where K'is equal to $[(kT/q)\ln(I_{S83}/I_{S70})]$, assuming $(I_{C83}=I_{C70})$. When current $I_{82}$ is mirrored to voltage reference circuit 52 through transistor 92, bandgap reference voltage $V_{REF}$ is expressed as $$V_{REF}=V_{BE95}+2K'R_{94}/R_{82} \quad [10]$$

If $(A_{70}=A_{26})$ and $(A_{83}=A_{30})$, then $(K=K')$ and the value of resistor 94 may be half the value of resistor 42 of FIG. 2 for a comparable value between resistor 82 and resistor 29. Obtaining a reference voltage in this way is advantageous because any offset due to mismatch between transistors 70 and 83, or 68 and 85, affects $V_{REF}$ proportionally to the ratio $(R_{94}/R_{82})$; thus, the impact of the offset is reduced.

Another advantage flows from the use of a two-$\Delta V_{BE}$ current reference. Integrated circuit resistors are very typically made of polysilicon because polysilicon resistors can have precise values, and polysilicon has a positive temperature coefficient which balances out the negative temperature coefficient of $V_{BE95}$. However, much polysilicon area is required because the resistivity of polysilicon is low. By halving the value of $R_{94}$ in voltage generator circuit 52, bandgap reference circuit 50 requires substantially less circuit area than circuit 40.

Yet another advantage is that the error currents are reduced. Transistor 98 is provided to offset the base current error at the second terminal of resistor 94 due to the base current of transistor 95. Additionally, the error current into node 54 is equal to $(I_{B68}+I_{B85})$. However, transistors 66 and 87 add a compensation current $(I_{B66}+I_{B87})$ to the current flowing into the drain of transistor 90. Thus, the current into node 54 may be expressed as $$I_{61}+I_{B68}+I_{B85}=I_{88}+I_{B66}+I_{B87} \quad [11].$$

By matching the base currents of transistors 66 and 68, and 87 and 85, $I_{61}$ is made equal to $I_{88}$, thus cancelling error currents. In the preferred embodiment, base currents are matched by matching both the collector currents and the emitter areas.

It is important to note that bandgap reference circuit 50 includes a startup circuit (not shown). In order to ensure that circuit 50 is biased properly when power is first applied, the startup circuit ensures proper initial bias conditions. Startup circuits are well known in the art, and a conventional startup circuit may be used. It is also important to note that by proper ratioing of the gate width-to-length ratios between transistors 81 and 92, a multiple of $I_{82}$ may be mirrored into resistor 94. Using a multiple of $I_{82}$ with a corresponding multiple increase of transistors 95–98 has the advantage that the value of resistor 94 may be further reduced, reducing the effect of offset voltage. However, this advantage must be traded off with the disadvantage of errors in ratioing of the transistors as a result of imperfections in the manufacturing process, which may tend to reduce the accuracy of $V_{REF}$.

Figure 4:
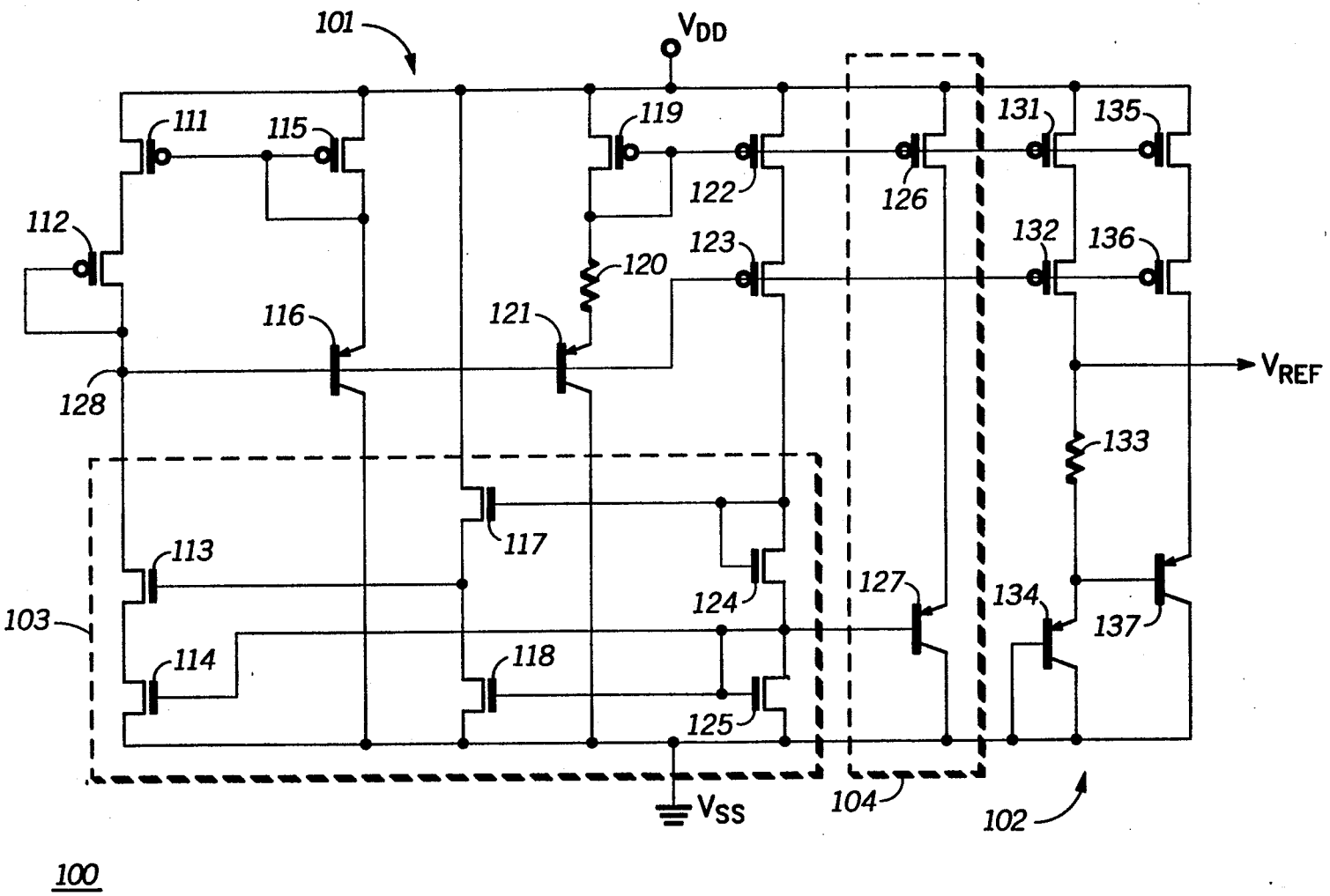
FIG. 4 illustrates in schematic form a bandgap reference circuit in accordance with a second embodiment of the present invention.

FIG. 4 illustrates in schematic form a bandgap reference circuit 100 in accordance with a second embodiment of present invention. Bandgap reference circuit 100 includes generally a reference current circuit 101, and a voltage generator circuit 102. Reference current circuit 101 includes P-channel transistors 111 and 112, N-channel transistors 113 and 114, a P-channel transistor 115, a PNP transistor 116, N-channel transistors 117 and 118, a P-channel transistor 119, a resistor 120, a PNP transistor 121, P-channel transistors 122 and 123, N-channel transistors 124 and 125, a P-channel transistor 126, and a PNP transistor 127. Voltage generator circuit 102 includes P-channel transistors 131 and 132, a resistor 133, a PNP transistor 134, P-channel transistors 135 and 136, and a PNP transistor 137. Transistors 113, 114, 117, 118, 124, and 125 collectively form a current mirror labelled 103. Transistors 126 and 127 collectively form a compensation circuit labelled 104.

Transistor 111 has a source connected to $V_{DD}$, a gate, and a drain. Transistor 112 has a source connected to the drain of transistor 111, a gate, and a drain connected to the gate of transistor 112. Transistor 113 has a drain connected to the drain of transistor 112, a gate, and a source. Transistor 114 has a drain connected to the source of transistor 113, a gate, and a source connected to $V_{SS}$. Transistor 115 has a source connected to $V_{DD}$, a gate, and a drain connected to the gates of transistors 111 and 115. Transistor 116 has an emitter connected to the drain of transistor 115, a base connected to the drain of transistor 112, and a collector connected to $V_{SS}$. Transistor 117 has a drain connected to $V_{DD}$, a gate, and a source. Transistor 118 has a drain connected to the source of transistor 117 and to the gate of transistor 113, a gate, and a source connected to $V_{SS}$. Transistor 119 has a source connected to $V_{DD}$, a gate, and a drain connected to the gate of transistor 119. Resistor 120 has a first terminal connected to the drain of transistor 119, and a second terminal. Transistor 121 has an emitter connected to the second terminal of resistor 120, a base connected to the drain of transistor 112, and a collector connected to $V_{SS}$. Transistor 122 has a source connected to $V_{DD}$, a gate connected to the drain of transistor 119, and a drain. Transistor 123 has a source connected to the drain of transistor 122, a gate connected to the drain of transistor 112, and a drain. Transistor 124 has a drain connected to the drain of transistor 123 and to the gate of transistor 117, a gate connected to the drain of transistor 124, and a source. Transistor 125 has a drain connected to the source of transistor 124, to the gate of transistor 114, and to the gate of transistor 118, a gate connected to the drain of transistor 125, and a source connected to $V_{SS}$. In compensation circuit 104, transistor 126 has a source connected to $V_{DD}$, a gate connected to the drain of transistor 119, and a drain. Transistor 127 has an emitter connected to the drain of transistor 126, a base connected to the drain of transistor 125, and a collector connected to $V_{SS}$.

In voltage generator circuit 102, transistor 131 has a source connected to $V_{DD}$, a gate connected to the drain of transistor 119, and a drain. Transistor 132 has a source connected to the drain of transistor 131, a gate connected to the drain of transistor 112, and a drain for providing reference voltage $V_{REF}$. Resistor 133 has a first terminal connected to the drain of transistor 132, and a second terminal. Transistor 134 has an emitter connected to the second terminal of resistor 133, a base connected to $V_{SS}$, and a collector connected to $V_{SS}$. Transistor 135 has a source connected to $V_{DD}$, a gate connected to the drain of transistor 119, and a drain. Transistor 136 has a source connected to the drain of transistor 135, a gate connected to the drain of transistor 112, and a drain. Transistor 137 has an emitter connected to the drain of transistor 136, a base connected to the emitter of transistor 134, and a collector connected to $V_{SS}$.

Bandgap reference circuit 100 maintains $V_{REF}$ within an acceptable accuracy of a desired voltage, to a lower power supply voltage than either circuit 40 of FIG. 2 or circuit 50 of FIG. 3. Current mirror 103 operates at a lower power supply voltage than the cascode current mirrors used by circuits 40 and 50. Current mirror 103, formed by transistors 113, 114, 117, 118, 124, and 125, is known as a high-swing cascode current mirror. The high-swing cascode current mirror effectively lowers the saturation threshold voltage of transistor 113, improving the headroom at node 128. Thus, circuit 100 maintains an accurate bandgap reference at lower values of $V_{DD}$ than circuit 50 of FIG. 3. In a preferred embodiment, transistors 113, 114, 117, 118, 124, and 125 in the highswing cascode current mirror have predetermined width-to-length ratios to maximize performance. The predetermined ratios are (W/L) for each of transistors 113, 114, 117, 118, and 125, and $((\frac{1}{4})(W/L))$ for transistor 124.

Furthermore, circuit 100 requires less integrated circuit area than circuit 50. Base current compensation in current reference circuit 101 differs from the current reference circuits previously illustrated. Transistor 27 of circuit 40 of FIG. 2 provides base current compensation by reducing the injected base current. In circuit 50 of FIG. 3, transistors 66 and 87 more precisely compensate for base current errors of the transistors forming the two-$\Delta V_{BE}$ reference. However, transistors 66 and 87 require extra integrated circuit area which may not be allowable for some circuit applications. Base current compensation is provided by compensation circuit 104, which couples the base of transistor 127 to the drain of transistor 125. Transistor 126 mirrors twice the current flowing through resistor 120 into the emitter of transistor 127, and transistor 127 has twice the emitter area of transistor 116. Thus, the current density of transistor 127 matches that of transistor 116. Since transistor 127 has twice the emitter area of transistor 116, transistor 127 approximately performs the same base current cancellation function as transistors 66 and 87 of FIG. 3, but requires much smaller amounts of integrated circuit area. This aspect of compensation circuit 104 follows from the characteristic of bipolar transistors that the base current is proportional to the collector current and to a first order independent of the geometric size of the transistor. For example, in the preferred embodiment the relative size (emitter area) of transistor 116 is one, and of transistor 121 is thirty-five; transistor 127, having a relative size of two and having twice the collector current, injects a base current approximately equal to the base currents of transistors 116 and 121 combined.

A performance tradeoff between circuit 50 of FIG. 2 and circuit 100 of FIG. 3 should be noted. Circuit 100 uses a one-$\Delta V_{BE}$ reference. In higher performance applications, it is advantageous to use two-$\Delta V_{BE}$ current reference circuit 51 of FIG. 3; in circuit 50 of FIG. 3, a two-$\Delta V_{BE}$ reference is obtained at the expense of voltage headroom, and hence the performance at lower values of $V_{DD}$ is reduced. In applications where integrated circuit area is important, the one-$\Delta V_{BE}$ approach may be preferred. In that case, the size of resistor 133 can be decreased, however, by mirroring an additional current through transistor 131. In the preferred embodiment, a current of $((3)(I_{120}))$ flows into the first terminal of resistor 133; thus the area savings of a two-$\Delta V_{BE}$ reference is overcome. Despite an inaccuracy which may result from sizing ratio errors between transistors 119 and 131, such an approach may be more advantageous when integrated circuit area is critical.

Thus, several circuits have been disclosed which improve performance of a reference current circuit or of a bandgap voltage reference circuit. Referring to FIG. 3, voltage generator circuit 52 includes base current compensation for transistor 95. Compensation circuit 55 provides compensation for base currents of transistors forming the $\Delta V_{BE}$ reference. Using a two-$\Delta V_{BE}$ reference halves the required size of resistor 94. Referring now to FIG. 4, high-swing cascode current mirror 103 reduces the minimum power supply voltage at which circuit 100 is operable. Compensation circuit 104 provides relatively accurate base current compensation at a reduced circuit area. Mirroring a multiple of the reference current through the output resistor reduces the value thereof, saving integrated circuit area. Any of these circuits and techniques may be used in similar current reference or bandgap voltage reference circuits to improve the operating characteristics of their respective circuits.

While the invention has been described in the context of a preferred embodiment, it will be apparent to those skilled in the art that the present invention may be modified in numerous ways and may assume many embodiments other than those specifically set out and described above. For example, reference current circuit 51 of FIG. 3 and reference current circuit 101 of FIG. 4 may be used in other applications besides bandgap reference circuits. Also, the width-to-length ratio of transistors used in current mirrors may be changed to reduce circuit area. Furthermore, the voltage at the drains of transistors 90 and 91 of FIG. 3 and 124 and 125 of FIG. 4 may be provided to other circuits to reproduce the reference current with the same function as signals NBIAS1 and NBIAS2 in FIG. 2. Accordingly, it is intended by the appended claims to cover all modifications of the invention which fall within the true spirit and scope of the invention.

We claim:

1. A bandgap voltage reference circuit comprising:

means for generating a first reference current;

a first resistor having a first terminal for providing a reference voltage, and a second terminal;

means coupled to said generating means for mirroring a second reference current into said first terminal of said first resistor, said second reference current proportional to said first reference current;

a first transistor having an emitter coupled to said second terminal of said first resistor, and having a base and a collector each coupled to a power supply voltage terminal; and means coupled to said second terminal of said first resistor for injecting a current substantially equal to a base current of said first transistor into an emitter of said first transistor.

2. The bandgap voltage reference circuit of claim 1 wherein said means for injecting comprises:

second transistor having an emitter, a base coupled to said emitter of said first transistor, and a collector coupled to said power supply voltage terminal; and means for mirroring a third reference current into said emitter of said second transistor, said third reference current proportional to said first reference current.

3. The bandgap voltage reference circuit of claim 1 wherein said generating means generates said first reference current as a two-$\Delta V_{BE}$ voltage divided by a value of a second resistor.

4. The bandgap voltage reference circuit of claim 3 wherein said generating means comprises:

a second transistor having a first current electrode coupled to a second power supply voltage terminal, a control electrode, and a second current electrode coupled to said control electrode of said second transistor;

a third transistor having an emitter coupled to said second current electrode of said second transistor, a base, and a collector coupled to said power supply voltage terminal;

a fourth transistor having a first current electrode coupled to said second power supply voltage terminal, a control electrode coupled to said second current electrode of said second transistor, and a second current electrode coupled to said base of said third transistor;

a fifth transistor having an emitter coupled to said second current electrode of said fourth transistor and to said base of said third transistor, a base coupled to a reference node, and a collector coupled to said power supply voltage terminal;

a sixth transistor having a first current electrode coupled to said second power supply voltage terminal, a control electrode, and a second current electrode coupled to said control electrode of said sixth transistor and providing said reference current;

said second resistor having a first terminal coupled to said second current electrode of said sixth transistor, and a second terminal;

a seventh transistor having an emitter coupled to said second terminal of said second resistor, a base, and a collector coupled to said power supply voltage terminal;

an eighth transistor having a first current electrode coupled to said second power supply voltage terminal, a control electrode coupled to said second current electrode of said sixth transistor, and a second current electrode coupled to said base of said seventh transistor; and a ninth transistor having an emitter coupled to said second current electrode of said eighth transistor and to said base of said seventh transistor, a base coupled to said reference node, and a collector coupled to said power supply voltage terminal.

5. The bandgap voltage reference circuit of claim 4 wherein said generating means further comprises:

means for mirroring said reference current into said node; and means for mirroring a second reference current into said node, said second reference current flowing into said emitter of said third transistor.

6. The bandgap voltage reference circuit of claim 5 wherein said generating means further comprises compensation means for adding a base current of said third transistor and a base current of said seventh transistor to said mirrored reference current.

7. The bandgap voltage reference circuit of claim 6 wherein said compensation means comprises:

a tenth transistor having a first current electrode coupled to said second power supply voltage terminal, a control electrode coupled to said second current electrode of said second transistor, and a second current electrode;

an eleventh transistor having an emitter coupled to said second current electrode of said tenth transistor, a base coupled to said means for mirroring said reference current, and a second current electrode coupled to said power supply voltage terminal;

a twelfth transistor having a first current electrode coupled to said second power supply voltage terminal, a control electrode coupled to said second current electrode of said sixth transistor, and a second current electrode; and a thirteenth transistor having an emitter coupled to said second current electrode of said twelfth transistor, a base coupled to said means for mirroring said reference current, and a collector coupled to said power supply voltage terminal.

8. The bandgap voltage reference circuit of claim 1 wherein said generating means comprises:

a second transistor having a first current electrode coupled to a second power supply voltage terminal, a control electrode, and a second current electrode coupled to said control electrode of said second transistor;

a third transistor having an emitter coupled to said second current electrode of said second transistor, a base coupled to a reference node, and a collector coupled to said power supply voltage terminal;

a fourth transistor having a first current electrode coupled to said second power supply voltage terminal, a control electrode, and a second current electrode coupled to said control electrode of said fourth transistor;

a second resistor having a first terminal coupled to said second current electrode of said fourth transistor, and a second terminal;

a fifth transistor having an emitter coupled to said second current electrode of said second resistor, a base coupled to said reference node, and a collector coupled to said power supply voltage terminal;

first current mirror means for mirroring a current flowing through said second resistor into said reference node;

second current mirror means for mirroring a current flowing through said second transistor into said reference node; and compensation means coupled to said first current mirror means, for increasing a current provided by said first current mirror means by an amount substantially equal to a sum of base currents of said third transistor and said fifth transistor.

9. The bandgap voltage reference circuit of claim 8 wherein said compensation means comprises:

a sixth transistor having an emitter, a base coupled to said first current mirror means, and a collector coupled to said power supply voltage terminal; and third current mirror means for mirroring said first reference current into said emitter of said sixth transistor.

10. A circuit comprising:

a reference node;

current means for providing a reference current equal to a $V_{BE}$ of a first transistor plus a $V_{BE}$ of a second transistor minus a $V_{BE}$ of a third transistor minus a $V_{BE}$ of a fourth transistor, divided by a value of a first resistor, said reference current flowing into an emitter of said fourth transistor, a second current flowing into an emitter of said first transistor, a third current proportional to said reference current flowing into an emitter of said third transistor, a fourth current proportional to said second current flowing into an emitter of said second transistor;

a first current mirror for mirroring a fifth current proportional to said second current into said reference node;

a second current mirror for mirroring a sixth current proportional to said reference current from said reference node;

feedback means coupled to said reference node and to said first current mirror for changing said second current until said fifth current is substantially equal to said sixth current; and compensation means for adding a base current of said second and third transistors to said sixth current.

11. The circuit of claim 10 further comprising means for generating a reference voltage in response to said reference current.

12. The circuit of claim 11 wherein said generating means comprises:

a second resistor having a first terminal for providing said reference voltage, and a second terminal;

a third current mirror for mirroring a seventh current proportional to said reference current into said first terminal of said second resistor; and a fifth transistor having an emitter coupled to a second terminal of said second resistor, a base coupled to a power supply voltage terminal, and a collector coupled to said power supply voltage terminal.

13. The circuit of claim 12 wherein said generating means further comprises:

a sixth transistor having an emitter, a base coupled to said emitter of said fifth transistor, and a collector coupled to said power supply voltage terminal; and a fourth current mirror for mirroring an eighth current proportional to said reference current into said emitter of said sixth transistor.

14. A circuit comprising:

a reference node;

current means for providing a reference current equal to a $V_{BE}$ of a first transistor minus a·$V_{BE}$ of a second transistor, divided by a value of a first resistor, said reference current flowing into an emitter of said second transistor, and for providing a second current flowing into an emitter of said first transistor;

a first current mirror for mirroring a third current proportional to said second current into said reference node;

a second current mirror, for mirroring a fourth current proportional to said reference current into said reference node, said second current mirror characterized as being a high-swing cascode current mirror; and feedback means coupled to said reference node and to said first current mirror for changing said second current until said third current is substantially equal to said fourth current.

15. The circuit of claim 14 further comprising compensation means for adding a fifth current substantially equal to a sum of base currents of said first transistor and said second transistor to said fourth current.

16. The circuit of claim 14 further comprising means for generating a reference voltage in response to said reference current.

17. The circuit of claim 16 wherein said generating means comprises:

a second resistor having a first terminal for providing said reference voltage, and a second terminal;

a third transistor having an emitter coupled to said second terminal of said second resistor, and having a base and a collector each coupled to a power supply voltage terminal; and a third current mirror coupled to said current means, for mirroring a fifth current proportional to said reference current into said first terminal of said second resistor.

18. The circuit of claim 17 wherein said generating means further comprises:

a fourth transistor having an emitter, a base coupled to said emitter of said third transistor, and a collector coupled to said power supply voltage terminal; and a fourth current mirror for mirroring a sixth current proportional to said reference current into said emitter of said fourth transistor.

19. A circuit comprising:

a reference node;

current means for providing a reference current equal to a $V_{BE}$ of a first transistor minus a $V_{BE}$ of a second transistor, divided by a value of a first resistor, said reference current flowing into an emitter of said second transistor, and for providing a second current flowing into an emitter of said first transistor;

a first current mirror for mirroring a third current proportional to said second current into said reference node; and a second current mirror, for mirroring a fourth current proportional to said reference current into said reference node;

feedback means coupled to said reference node and to said first current mirror for changing said second current until said third current is substantially equal to said fourth current; and compensation means coupled to said second current mirror, for adding a fifth current substantially equal to a sum of base currents of said first transistor and said second transistor to said mirrored reference current.

20. The circuit of claim 19 wherein said compensation means comprises:

a third transistor having an emitter, a base coupled to said second current mirror, and a collector coupled to said power supply voltage terminal; and a third current mirror for mirroring said fifth current into said emitter of said third transistor.

21. The circuit of claim 20 wherein an emitter area of said third transistor is substantially equal to twice an emitter area of said first transistor.

* * * * *